US012487007B2

(12) United States Patent
Yada et al.

(10) Patent No.: US 12,487,007 B2
(45) Date of Patent: Dec. 2, 2025

(54) INDOOR UNIT FOR AIR-CONDITIONING APPARATUS AND METHOD OF DETACHING AIR-DEFLECTOR PLATE

(71) Applicant: Mitsubishi Electric Corporation, Tokyo (JP)

(72) Inventors: Mizuki Yada, Tokyo (JP); Hisanori Ikeda, Tokyo (JP); Takuya Niimura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 386 days.

(21) Appl. No.: 18/043,776

(22) PCT Filed: Nov. 20, 2020

(86) PCT No.: PCT/JP2020/043402
§ 371 (c)(1),
(2) Date: Mar. 2, 2023

(87) PCT Pub. No.: WO2022/107314
PCT Pub. Date: May 27, 2022

(65) Prior Publication Data
US 2023/0375215 A1 Nov. 23, 2023

(51) Int. Cl.
*F24F 13/14* (2006.01)
*F24F 1/0011* (2019.01)
*F24F 1/0057* (2019.01)

(52) U.S. Cl.
CPC ..... *F24F 13/14* (2013.01); *F24F 1/0011* (2013.01); *F24F 1/0057* (2019.02)

(58) Field of Classification Search
CPC ..... F24F 13/14; F24F 1/0011; F24F 1/0057; F24F 13/084
See application file for complete search history.

(56) References Cited

FOREIGN PATENT DOCUMENTS

| | | | | |
|---|---|---|---|---|
| CN | 111365765 A | * | 7/2020 | ..... F24F 1/0011 |
| JP | 2002071206 A | * | 3/2002 | |
| JP | 2003-240258 A | | 8/2003 | |
| JP | 2005090927 A | * | 4/2005 | |
| JP | 2008261564 A | * | 10/2008 | |

(Continued)

OTHER PUBLICATIONS

Machine Translation of JP 2014190584A (Year: 2014).*

(Continued)

*Primary Examiner* — Steven B Mcallister
*Assistant Examiner* — Amy E Cater
(74) *Attorney, Agent, or Firm* — Posz Law Group, PLC

(57) ABSTRACT

An indoor unit for an air-conditioning apparatus has an attachment portion has a plate portion that is in contact with one face of a first projection portion in an axial direction and is larger in width than a first shaft opening port, a shaft portion that extends from the plate portion and is inserted into the first shaft opening port, a support opening port, and a second shaft opening port, and an engagement claw portion that is engaged with an other face of the first projection portion that is opposite to the one face, and a second projection portion has a notch that is cut along a direction in which the shaft portion extends and through which the shaft portion is exposed.

3 Claims, 14 Drawing Sheets

(56) References Cited

FOREIGN PATENT DOCUMENTS

| | | | |
|---|---|---|---|
| JP | 5489956 | B2 * | 5/2014 |
| JP | 2014190584 | A * | 10/2014 |

OTHER PUBLICATIONS

CN 111365765 with Machine Translation (Year: 2020).*
JP 2002071206A with Machine Translation (Year: 2002).*
JP 2005090927 with Machine Translation (Year: 2005).*
JP 2008261564 with Machine Translation (Year: 2008).*
JP 5489956B2 with Machine Translation (Year: 2014).*
International Search Report of the International Searching Authority mailed Dec. 28, 2020 for the corresponding international application No. PCT/JP2020/043402 (and English translation).

* cited by examiner

INDOOR UNIT FOR AIR-CONDITIONING APPARATUS AND METHOD OF DETACHING AIR-DEFLECTOR PLATE

CROSS REFERENCE TO RELATED APPLICATION

This application is a U.S. national stage application of PCT/JP2020/043402 filed on Nov. 20, 2020, the contents of which are incorporated herein by reference.

TECHNICAL FIELD

The present disclosure relates to an indoor unit for an air-conditioning apparatus that is provided with an air-deflector plate and a method of detaching an air-deflector plate.

BACKGROUND ART

Some indoor unit for an air-conditioning apparatus has been known of which an air-deflector plate is detachable. Of such an indoor unit for an air-conditioning apparatus, an air-deflector plate is attached to a main body of the indoor unit by inserting an attachment portion into an opening port formed in the main body of the indoor unit and an opening port formed in a side plate that projects from a blade portion of the air-deflector plate. When the air-deflector plate is attached to the main body of the indoor unit, the attachment portion is also engaged with and fixed to the air-deflector plate. Patent Literature 1 discloses an indoor unit for an air-conditioning apparatus in which a knob of an attachment portion is slid and the attachment portion and an air-deflector plate, which are engaged with each other, are thus released from each other and the air-deflector plate is allowed to be detached from a main body of the indoor unit.

CITATION LIST

Patent Literature

Patent Literature 1: Japanese Unexamined Patent Application Publication No. 2002-71206

SUMMARY OF INVENTION

Technical Problem

In the indoor unit for an air-conditioning apparatus disclosed in Patent Literature 1, however, in a case in which a force is applied to the air-deflector plate in a direction of a rotation axis, the force is mainly applied to an engagement portion at which the attachment portion and the air-deflector plate are engaged with each other. When a user performs maintenance, such as cleaning, in a state in which the air-deflector plate is left attached to the main body of the indoor unit, the attachment portion and the air-deflector plate, which are engaged with each other, may be thus unintentionally released from each other and the air-deflector plate may fall off from the main body of the indoor unit.

In an indoor unit that allows an attachment portion to move together with an air-deflector plate, which also moves, on the other hand, even in a case in which a force is applied to the air-deflector plate in a direction of a rotation axis, the attachment portion and the air-deflector plate, which are engaged with each other, are less likely to be released from each other and the air-deflector plate may not fall off from the main body of the indoor unit. In such an indoor unit, however, the attachment portion is not easily detached from the air-deflector plate. The air-deflector plate is thus not easily detached from the main body of the indoor unit and maintenance of the inside of the indoor unit requires extra work.

The present disclosure is made to solve such a problem and to provide an indoor unit for an air-conditioning apparatus and a method of detaching an air-deflector plate for which maintenance is further easily performed.

Solution to Problem

An indoor unit for an air-conditioning apparatus according to an embodiment of the present disclosure is an indoor unit that has an air-deflector plate that adjusts a direction of air, an air-outlet unit that has a base in which an air outlet through which air is blown out is formed and to which the air-deflector plate is attached such that the air-deflector plate covers the air outlet, and an attachment portion to be attached to the air-outlet unit such that the air-deflector plate is rotatable, in which the base of the air-outlet unit has a shaft-support portion that is located at the air outlet and at which a support opening port is formed such that the support opening port opens in an axial direction around which the air-deflector plate rotates, the air-deflector plate has a blade portion that is plate-shaped, a first projection portion that projects from the blade portion toward the air outlet and at which a first shaft opening port is formed, and a second projection portion that projects from the blade portion toward the air outlet and faces the first projection portion across the shaft-support portion and at which a second shaft opening port is formed, the attachment portion has a plate portion that is in contact with one face of the first projection portion in the axial direction and is larger in width than the first shaft opening port, a shaft portion that extends from the plate portion and is inserted into the first shaft opening port, the support opening port, and the second shaft opening port, and an engagement claw portion that is engaged with an other face of the first projection portion that is opposite to the one face, and the second projection portion has a notch that is cut along a direction in which the shaft portion extends and through which the shaft portion is exposed.

Advantageous Effects of Invention

According to an embodiment of the present disclosure, the attachment portion is fixed to the air-deflector plate such that the first projection portion is sandwiched by the plate portion and the engagement claw portion. The attachment portion thus moves together with the air-deflector plate, which also moves. Even in a case in which a force is applied to the air-deflector plate in a direction of a rotation axis, the attachment portion is less likely to come off from the air-deflector plate. A user thus easily performs maintenance, such as cleaning, in a state in which the air-deflector plate is left attached to the air-outlet unit. In addition, the second projection portion has the notch. In a state in which the air-deflector plate is held, when a rod-shaped tool is pushed onto the distal end of the shaft portion and along the notch such that the attachment portion is pushed toward the first projection portion, the attachment portion and the air-deflector plate, which are engaged with each other, are thus released from each other. A user is thus allowed to detach the air-deflector plate from the air-outlet unit and easily perform maintenance of the inside of the indoor unit. As described above, with the indoor unit for an air-conditioning apparatus according to the present disclosure, maintenance is further easily performed.

DESCRIPTION OF EMBODIMENTS

Embodiment 1

Figure 1:
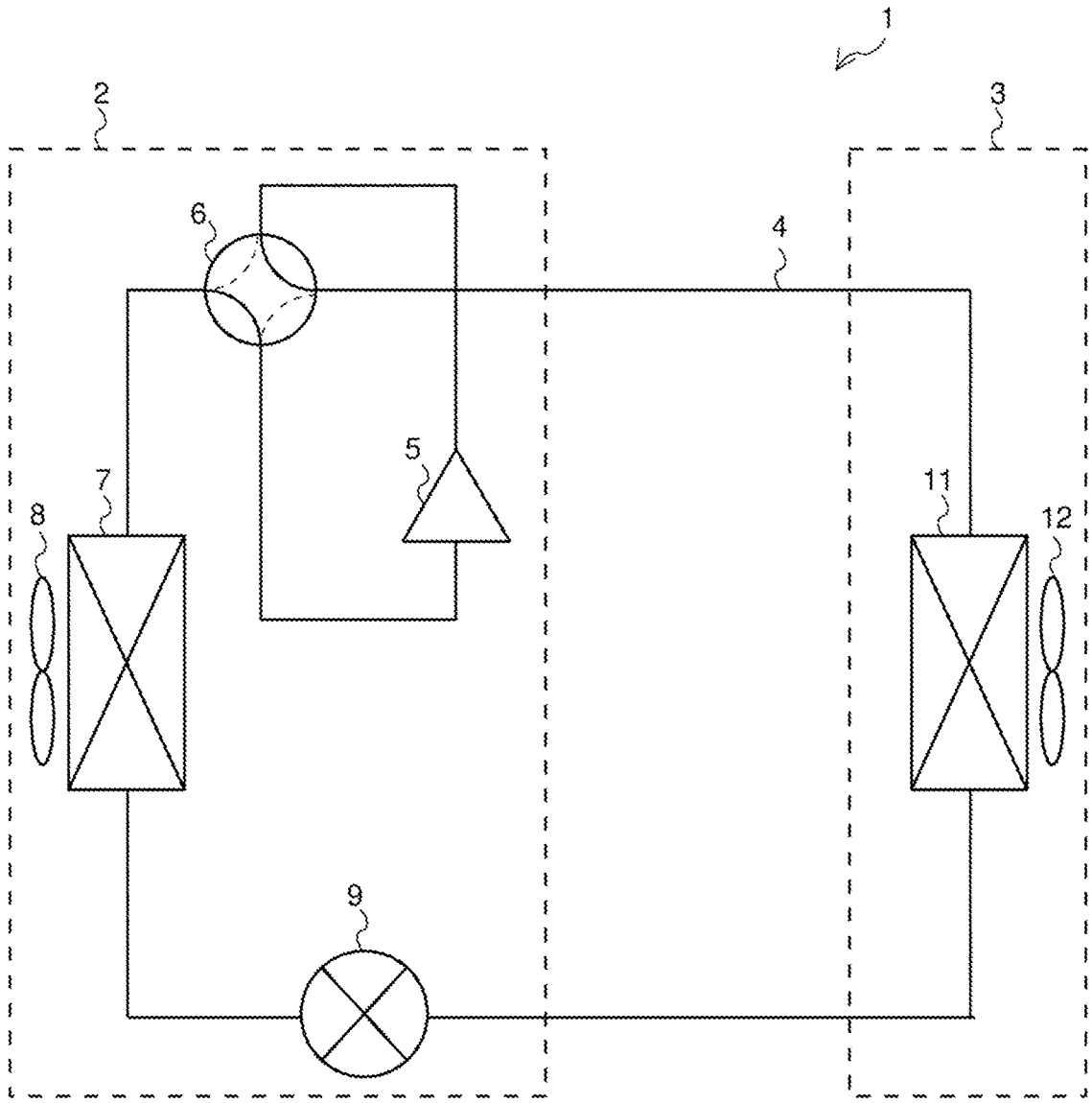
FIG. 1 is a circuit diagram that illustrates an air-conditioning apparatus 1 according to Embodiment 1.

An indoor unit 3 for an air-conditioning apparatus 1 according to Embodiment 1 is described below with reference to the drawings. FIG. 1 is a circuit diagram that illustrates the air-conditioning apparatus 1 according to Embodiment 1. As illustrated in FIG. 1, the air-conditioning apparatus 1 includes an outdoor unit 2 and an indoor unit 3, and a refrigerant pipe 4. One indoor unit 3 is illustrated in FIG. 1 as an example; however, the number of the indoor units 3 may also be two or more.

As illustrated in FIG. 1, the outdoor unit 2 has a compressor 5, a flow-passage selector valve 6, an outdoor heat exchanger 7, an outdoor air-sending device 8, and an expansion valve 9. The indoor unit 3 has an indoor heat exchanger 11 and an indoor air-sending device 12. The refrigerant pipe 4 is a pipe that connects the flow-passage selector valve 6, the outdoor heat exchanger 7, the expansion valve 9, and the indoor heat exchanger 11 with each other and refrigerant flows in the inside of the pipe. The refrigerant pipe 4 and such devices connected to the refrigerant pipe 4 forms a refrigerant circuit.

The compressor 5 is a device that sucks low-temperature and low-pressure refrigerant, compresses the sucked refrigerant into high-temperature and high-pressure refrigerant, and then discharges the refrigerant. The flow-passage selector valve 6 is a device, such as a four-way valve, that switches flow directions in which refrigerant flows in the refrigerant circuit. The outdoor heat exchanger 7 is a device, such as a fin-and-tube heat exchanger, that allows refrigerant and outdoor air to exchange heat with each other. The outdoor heat exchanger 7 serves as a condenser in cooling operation and serves as an evaporator in heating operation. The outdoor air-sending device 8 is a device that sends outdoor air to the outdoor heat exchanger 7. The expansion valve 9 is a device, such as an electronic expansion valve, that decompresses and expands refrigerant.

The indoor heat exchanger 11 is a device that allows indoor air and refrigerant to exchange heat with each other. The indoor heat exchanger 11 serves as an evaporator in cooling operation and serves as a condenser in heating operation. The indoor air-sending device 12 is a device, such as a cross-flow fan, that sends indoor air to the indoor heat exchanger 11.

Actions of the air-conditioning apparatus 1 are described below. Cooling operation is described first. The air-conditioning apparatus 1 performs cooling operation by causing the flow-passage selector valve 6 to switch flow passages such that a discharge port of the compressor 5 and the outdoor heat exchanger 7 are connected to each other. In cooling operation, refrigerant sucked into the compressor 5 is compressed by the compressor 5 and the resultant refrigerant in a high-temperature and high-pressure gas state is discharged. The refrigerant in a high-temperature and high-pressure gas state discharged from the compressor 5 passes through the flow-passage selector valve 6 and flows into the outdoor heat exchanger 7, which serves as a condenser. The refrigerant that has flowed into the outdoor heat exchanger 7 exchanges heat with outdoor air sent from the outdoor air-sending device 8 and thus condenses and liquefies. The resultant refrigerant in a liquid state flows into the expansion valve 9 and is decompressed and expanded into a low-temperature and low-pressure two-phase gas-liquid refrigerant. The two-phase gas-liquid refrigerant flows into the indoor heat exchanger 11, which serves as an evaporator. The refrigerant that has flowed into the indoor heat exchanger 11 exchanges heat with indoor air sent from the indoor air-sending device 12 and thus evaporates and gasifies. At this time, the indoor air is cooled and cooling operation is thus performed in a room. The resultant refrigerant in a low-temperature and low-pressure gas state that has evaporated subsequently passes through the flow-passage selector valve 6 and is sucked into the compressor 5.

Heating operation is described next. The air-conditioning apparatus 1 performs heating operation by causing the flow-passage selector valve 6 to switch flow passages such that the discharge port of the compressor 5 and the indoor heat exchanger 11 are connected to each other. In heating operation, refrigerant sucked into the compressor 5 is compressed by the compressor 5 and the resultant refrigerant in a high-temperature and high-pressure gas state is discharged. The refrigerant in a high-temperature and high-pressure gas state discharged from the compressor 5 passes through the flow-passage selector valve 6 and flows into the indoor heat exchanger 11, which serves as a condenser. The refrigerant that has flowed into the indoor heat exchanger 11 exchanges heat with indoor air sent from the indoor air-sending device 12 and thus condenses and liquefies. At this time, the indoor air is heated and heating operation is thus performed in a room. The resultant refrigerant in a liquid state flows into the expansion valve 9 and is decompressed and expanded into a low-temperature and low-pressure two-phase gas-liquid refrigerant. The two-phase gas-liquid refrigerant flows into the outdoor heat exchanger 7, which serves as an evaporator. The refrigerant that has flowed into the outdoor heat exchanger 7 exchanges heat with outdoor sent from the outdoor air-sending device 8 and thus evaporates and gasifies. The resultant refrigerant in a low-temperature and low-pressure gas state that has evaporated subsequently passes through the flow-passage selector valve 6 and is sucked into the compressor 5.

Figure 2:
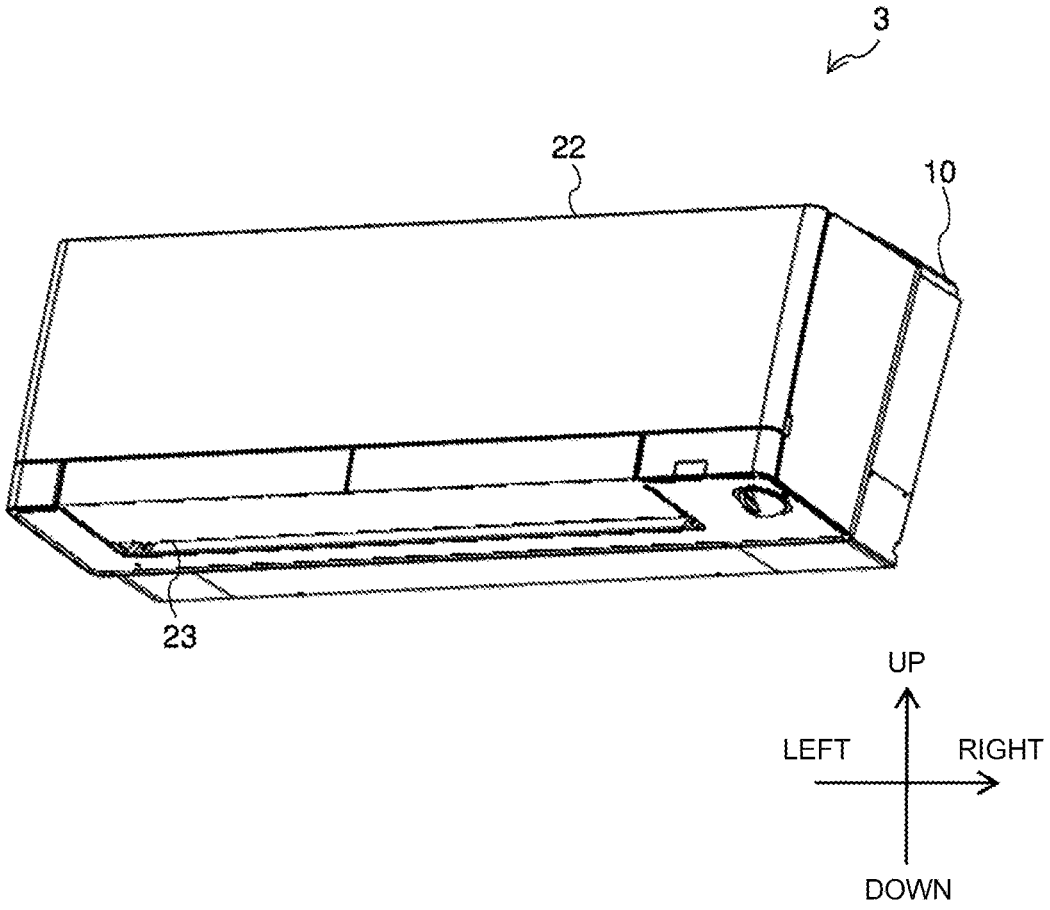
FIG. 2 is a perspective diagram that illustrates an indoor unit 3 according to Embodiment 1.

FIG. 2 is a perspective diagram that illustrates the indoor unit 3 according to Embodiment 1. The indoor unit 3 according to Embodiment 1 is a wall-mounted indoor unit and, as illustrated in FIG. 2, a longitudinal direction of the indoor unit 3 coincides with a left-right direction. The indoor unit 3 is, however, not limited to such a wall-mounted indoor unit and may also be, for example, a floor-standing indoor unit or a ceiling-embedded indoor unit.

Figure 3:
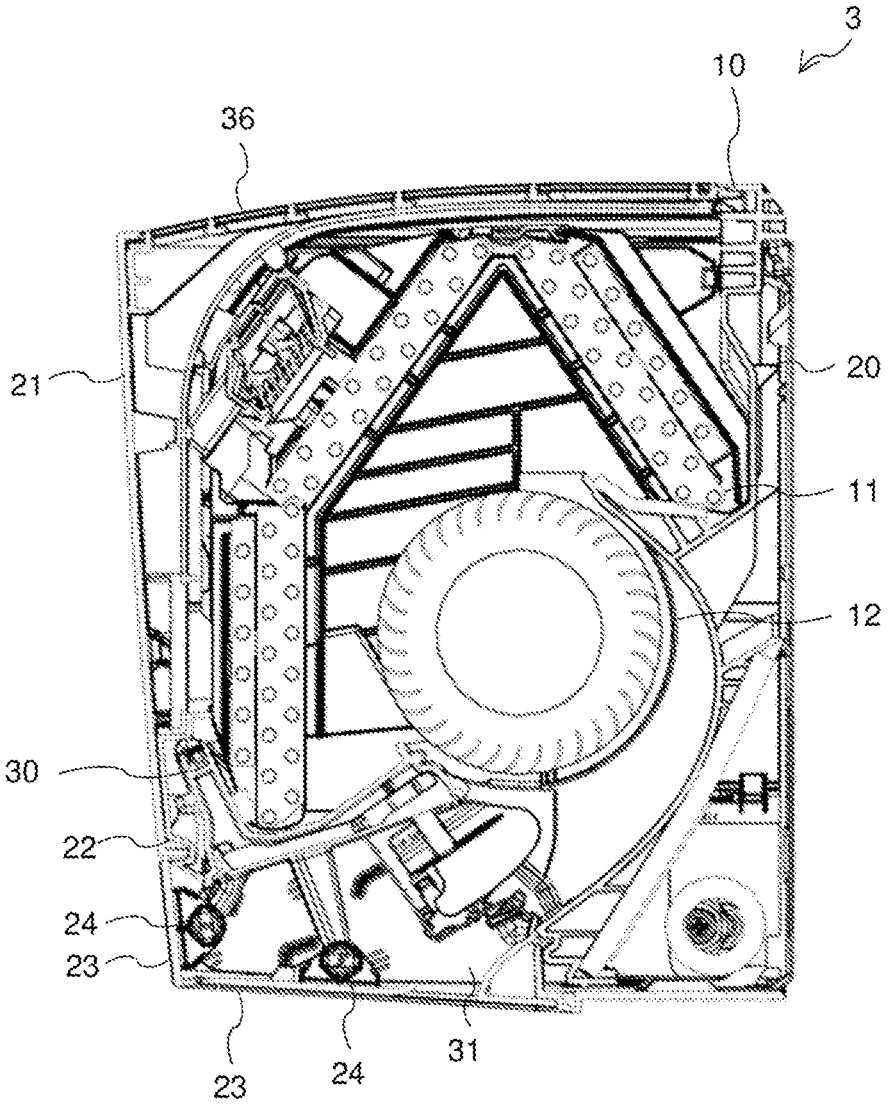
FIG. 3 is a schematic sectional diagram that illustrates the indoor unit 3 according to Embodiment 1.
Figure 4:
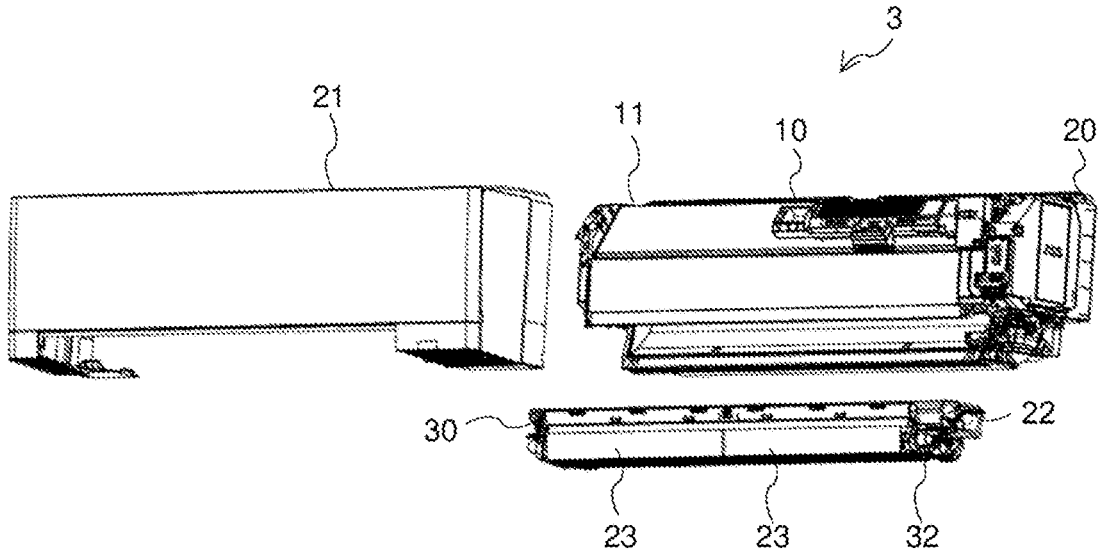
FIG. 4 is an exploded perspective diagram that illustrates the indoor 3 according to Embodiment 1.

FIG. 3 is a schematic sectional diagram that illustrates the indoor unit 3 according to Embodiment 1. FIG. 3 illustrates a section of the indoor unit 3 obtained by vertically cutting the center of the indoor unit 3. FIG. 4 is an exploded perspective diagram that illustrates the indoor unit 3 according to Embodiment 1. As illustrated in FIG. 3 and FIG. 4, the indoor unit 3 has a main-body unit 10, a panel 21, an air-outlet unit 22, and air-deflector plates 23. As illustrated in FIG. 3, the indoor unit 3 also has attachment portions 24, at which the air-deflector plates 23 are attached to the air-outlet unit 22.

The main-body unit 10 has a base stand 20, the indoor heat exchanger 11, and the indoor air-sending device 12 and is configured to condition indoor air. The base stand 20 serves as a rear face of the indoor unit 3 and is attached to, for example, a wall of a room. The indoor air-sending device 12 is attached to the base stand 20 and located at the center of the main-body unit 10. The indoor heat exchanger 11 is attached to the base stand 20 and covers the front and the top of the indoor air-sending device 12.

The panel 21 serves as a shell of the indoor unit 3. The panel 21 houses the main-body unit 10 and the air-outlet unit 22. The panel 21 is made of, for example, resin. In the panel 21, an air inlet 36 is formed. The air inlet 36 is an opening port formed in an upper portion of the panel 21 and through which indoor air is sucked into the inside of the indoor unit 3. The air inlet 36 may also be formed in a front face of the panel 21.

Figure 5:
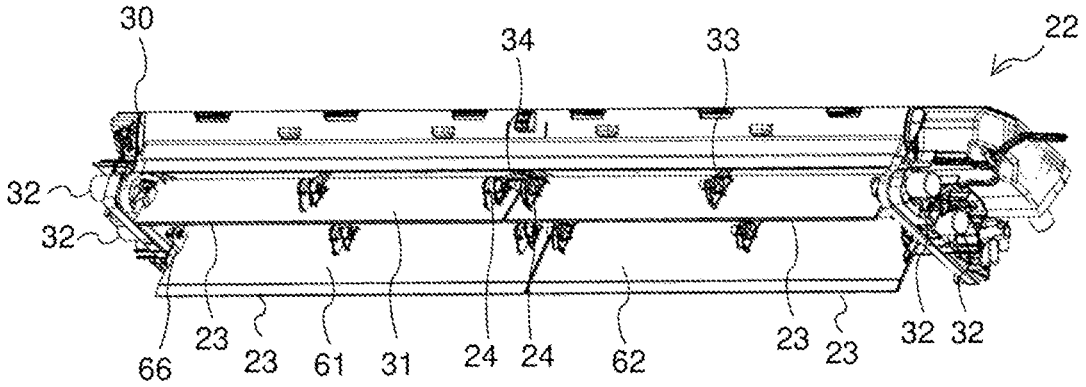
FIG. 5 is a perspective diagram that illustrates an air-outlet unit 22 according to Embodiment 1.
Figure 6:
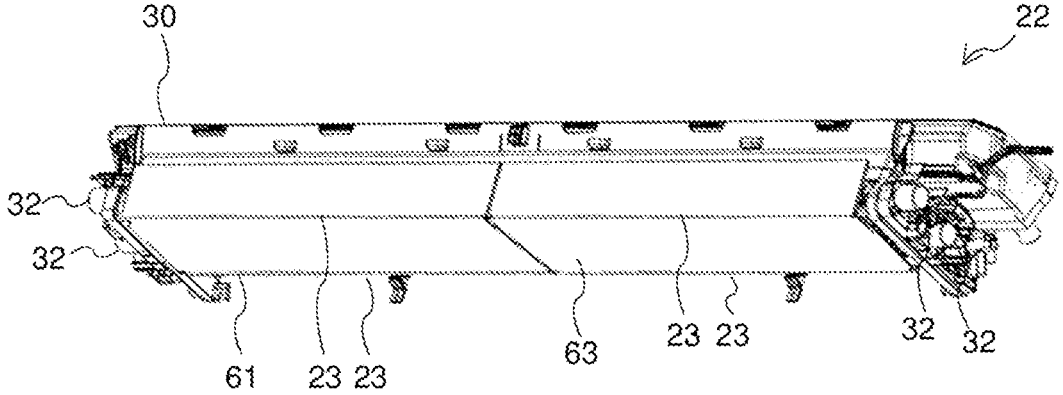
FIG. 6 is a perspective diagram that illustrates the air-outlet unit 22 according to Embodiment 1.

The air-outlet unit 22 is located at a lower portion of the indoor unit 3. FIG. 5 is a perspective diagram that illustrates the air-outlet unit 22 according to Embodiment 1. FIG. 5 illustrates the air-outlet unit 22 in a state in which the indoor unit 3 is operating. FIG. 6 is a perspective diagram that illustrates the air-outlet unit 22 according to Embodiment 1. FIG. 6 illustrates the air-outlet unit 22 in a state in which operation of the indoor unit 3 is stopped. As illustrated in FIG. 5 and FIG. 6, the air-outlet unit 22 has a base 30 and motors 32 attached to the base 30. The base 30 is a frame body in which an air outlet 31 is formed. Each two of the motors 32 are located at the corresponding one of opposite side ends of the base 30. An unillustrated drive shaft is provided to each of the motors 32 and rotates together with drive of the motor 32. The drive shaft of each of the motors 32 is inserted into the corresponding one of motor attachment portions 66.

To the air-outlet unit 22, the four air-deflector plates 23 are attached such that the air-deflector plates 23 cover the air outlet 31 formed in the base 30. Each two of the air-deflector plates 23 are located on each of the left and right. Each of the air-deflector plates 23 is a plate-shaped component that extends in a left-right direction. On each of the left and right, one of the two air-deflector plates 23 covers a front portion of the air outlet 31 and the other one covers a lower portion of the air outlet 31. The four air-deflector plates 23 are attached to the base 30 by use of a plurality of attachment portions 24. The structure of the air-deflector plate 23 is described later.

As illustrated in FIG. 5, in a state in which the indoor unit 3 is operating, the air-outlet unit 22 vertically rotates each of the air-deflector plates 23 and thus adjusts an up-down direction in which air is blown out from the air outlet 31. Meanwhile, as illustrated in FIG. 6, in a state in which operation of the indoor unit 3 is stopped, the air-outlet unit 22 closes the four air-deflector plates 23. At this time, the entirety of the air outlet 31 is covered by the four air-deflector plates 23.

Figure 7:
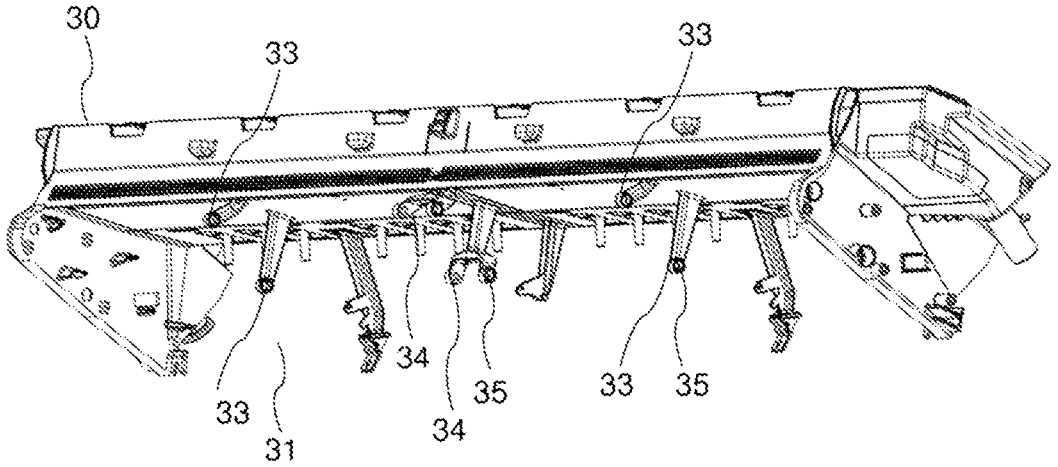
FIG. 7 is a perspective diagram that illustrates a base 30 according to Embodiment 1.

FIG. 7 is a perspective diagram that illustrates the base 30 according to Embodiment 1. As illustrated in FIG. 7, the air outlet 31 is formed in the base 30. The air outlet 31 is a region formed at a lower portion of the air-outlet unit 22. Through the air outlet 31, air sent from the indoor air-sending device 12 is blown out.

The base 30 has first shaft-support portions 33 and second shaft-support portions 34. The four first shaft-support portions 33 are located at the base 30. The first shaft-support portions 33 are each a rod-shaped component that extends toward the air outlet 31. Each two of the first shaft-support portions 33 are located on each of the left and right of the base 30. On each of the left and right, the two first shaft-support portions 33 are located such that one of the two first shaft-support portions 33 extends frontward and the other one extends downward. In each of the first shaft-support portions 33, a support opening port 35 is formed. The support opening ports 35 are each an opening port that extends through in a left-right direction.

The two second shaft-support portions 34 are located at a substantial center of the base 30. The two second shaft-support portions 34 are formed such that one of the two second shaft-support portions 34 extends frontward and the other one extends downward. Each of the second shaft-support portions 34 has an end portion, which is forked into two distal ends. In each of the respective two distal ends of the second shaft-support portions 34, one support opening port 35 is formed. The support opening ports 35 are each an opening port that extends through in a left-right direction.

Figure 8:
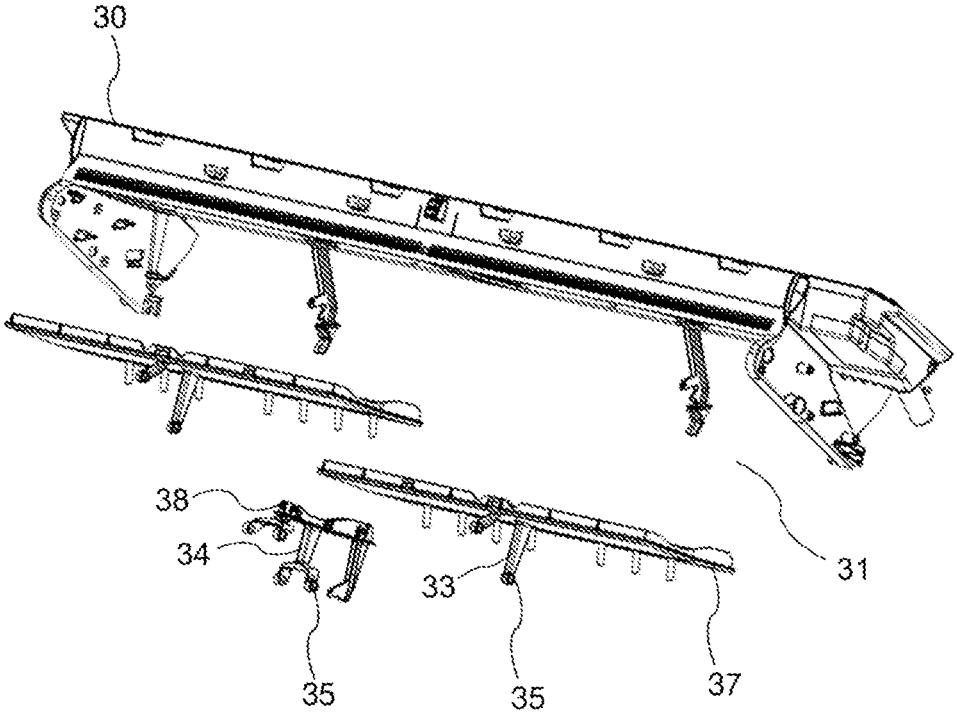
FIG. 8 is an exploded perspective diagram that illustrates the base 30 according to Embodiment 1.

FIG. 8 is an exploded perspective diagram that illustrates the base 30 according to Embodiment 1. FIG. 8 illustrates a state in which the base 30 is disassembled. As illustrated in FIG. 8, the base 30 has rear plate portions 37 and a connection portion 38. The rear plate portions 37 are each a plate-shaped component that connects the corresponding two of the first shaft-support portions 33, one of which extends frontward and the other of which extends downward, to each other. The two rear plate portions 37 are each provided to the corresponding ones of the left and right first shaft-support portions 33. The connection portion 38 is a component that connects the second shaft-support portions 34, one of which extends frontward and the other of which extends downward, to each other.

Figure 9:
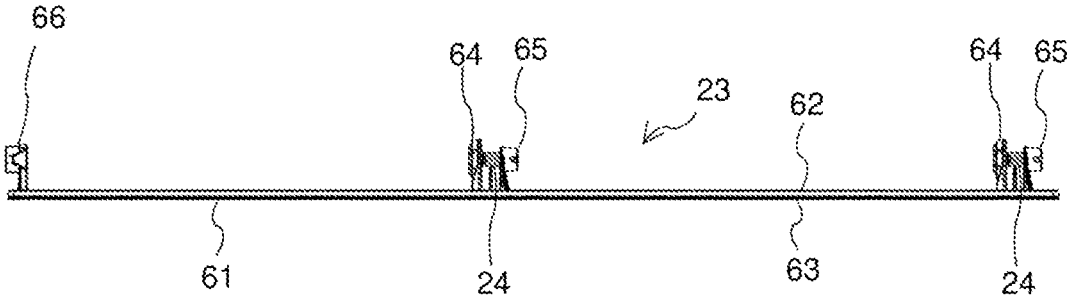
FIG. 9 is a perspective diagram that illustrates an air-deflector plate 23 according to Embodiment 1.

FIG. 9 is a perspective diagram that illustrates the air-deflector plate 23 according to Embodiment 1. In FIG. 9, the air-deflector plate 23 that is attached to the left of the air-outlet unit 22 is illustrated as an example. The air-deflector plates 23 that are attached to the right of the air-outlet unit 22, which are not described in detail, differ from the air-deflector plates 23 that are attached to the left of the air-outlet unit 22 in that the left ones and the right ones are symmetric. A left-right direction of the air-deflector plate 23 coincides with a direction of a rotation axis about which the air-deflector plate 23 rotates and the longitudinal direction of the air-deflector plate 23. The air-deflector plates 23 each have a blade portion 61, first projection portions 64, second projection portions 65, and the motor attachment portion 66.

The blade portion 61 is a plate-shaped component that has an air-guide face 62 and a design face 63. The air-guide face 62 is a face with which air blown out from the air outlet 31 is in contact in a state in which the indoor unit 3 is operating. The air-guide face 62 faces toward the inside of the indoor unit 3 in a state in which operation of the indoor unit 3 is stopped. The design face 63 is a face that faces toward the outside of the indoor unit 3 in a state in which operation of the indoor unit 3 is stopped.

The first projection portions 64 and the second projection portions 65 are located at the blade portion 61. A set of the first projection portion 64 and the second projection portion 65 each project from the right portion of the air-guide face 62. Another set of the first projection portion 64 and the second projection portion 65 each project from the center portion of the air-guide face 62. Each of the first projection portions 64 and the corresponding one of the second projection portions 65 face each other as one set. That is, two sets of the first projection portion 64 and the second projection portion 65 are located at each of the air-deflector plates 23. Into a set of the first projection portion 64 and the second projection portion 65, one of the attachment portions 24 is inserted. The motor attachment portion 66 is located at the left portion of the air-guide face 62 and into which the drive shaft of the corresponding one of the motors 32 is inserted.

Figure 10:
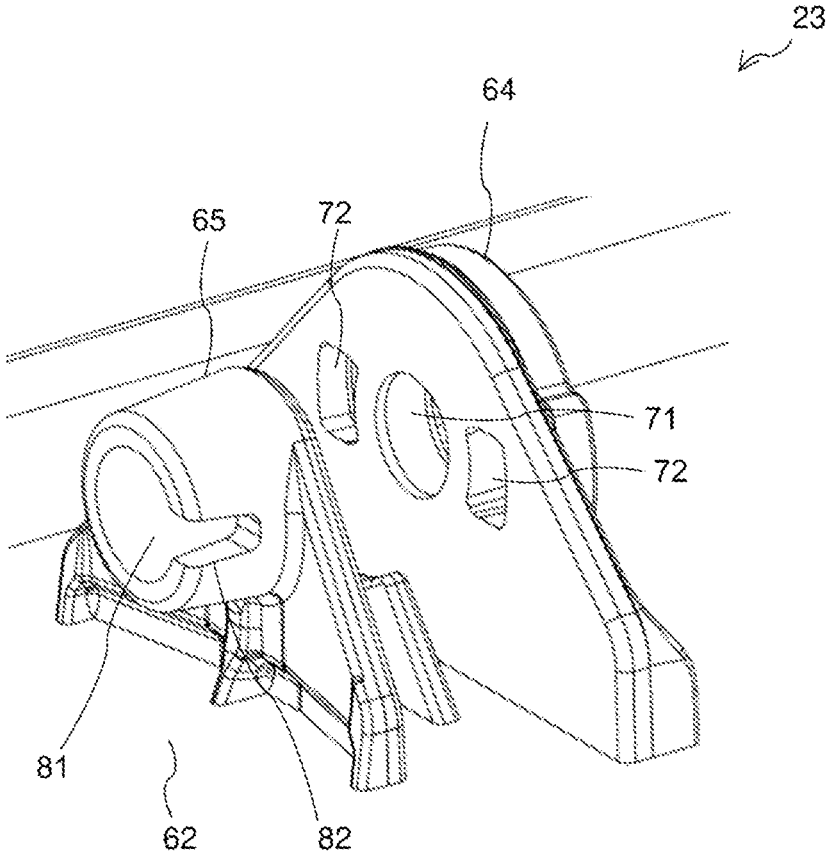
FIG. 10 is a perspective diagram that illustrates the air-deflector plate 23 according to Embodiment 1.

FIG. 10 is a perspective diagram that illustrates the air-deflector plate 23 according to Embodiment 1. FIG. 10 is an enlarged diagram that illustrates the first projection portion 64 and the second projection portion 65 and their vicinity located at a right one of the air-deflector plates 23. As illustrated in FIG. 10, in the first projection portion 64, a first shaft opening port 71 and claw-portion opening ports 72 are formed. The first shaft opening port 71 is an opening port that extends through the center of the first projection portion 64 in the left-right direction of the air-deflector plate 23. The claw-portion opening ports 72 are each an opening port that extends through the corresponding one of the side portions of the first projection portion 64 in the left-right direction of the air-deflector plate 23. The claw-portion opening ports 72 are two, one of which is formed across the first shaft opening port 71 from the other one.

The second projection portion 65 faces the first projection portion 64. In the second projection portion 65, the second shaft opening port 81 is formed. The second shaft opening port 81 is an opening port that extends through the second projection portion 65 in the left-right direction of the air-deflector plate 23. In the second projection portion 65, the notch 82 is cut. In the following description, an up-down dimension of the notch 82 is defined as its width and a left-right dimension of the notch 82 is defined as its length. The length of the notch 82 is larger than its width. For example, the width is 5 mm and the length is 10 mm.

Figure 11:
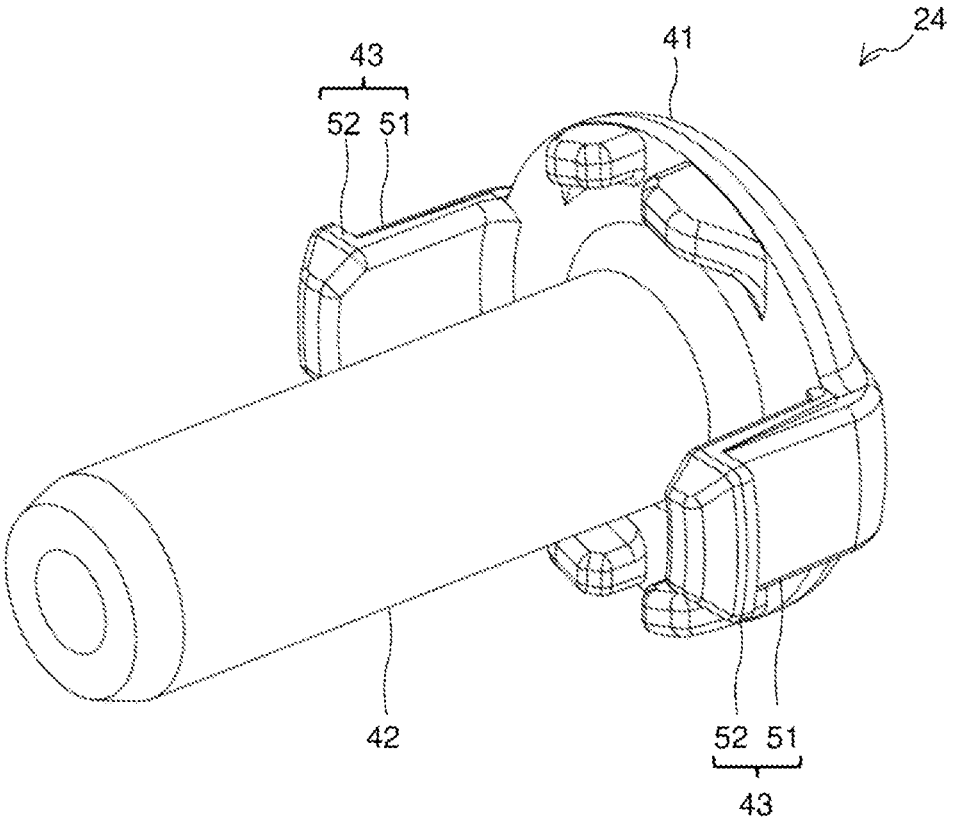
FIG. 11 is a perspective diagram that illustrates an attachment portion 24 according to Embodiment 1.

FIG. 11 is a perspective diagram that illustrates the attachment portion 24 according to Embodiment 1. The attachment portions 24 are each a component with which the corresponding one of the air-deflector plates 23 is attached to the air-outlet unit 22. As illustrated in FIG. 10, the attachment portions 24 each have a plate portion 41, a shaft portion 42, and engagement claw portions 43. The plate portion 41 is a disc-shaped component. The shaft portion 42 is a rod-shaped component that extends from the center portion of the plate portion 41. The engagement claw portions 43 are each a claw-shaped component that extends parallel to the shaft portion 42 from an outer circumference portion of the plate portion 41. The engagement claw portions 43 are two, one of which is formed across the shaft portion 42 from the other one. The engagement claw portions 43 each include a rod-shaped portion 51 and a return portion 52. The rod-shaped portion 51 is a portion that is rod-shaped and extends parallel to the shaft portion 42. The return portion 52 is a claw-shaped portion that projects from the distal end of the rod-shaped portion 51 toward an outer circumference of the plate portion 41.

As described above with reference to FIG. 5 to FIG. 11, to the air-outlet unit 22, the four air-deflector plates 23 are attached by use of the attachment portions 24. Specifically, to a front left one of the first shaft-support portions 33, the first projection portion 64 and the second projection portion 65 that are located at the center of a front left one of the air-deflector plates 23 are attached. To a left end of a front one of the second shaft-support portions 34, the first projection portion 64 and the second projection portion 65 that are located at a right portion of the front left one of the air-deflector plates 23 are also attached. In addition, to a lower left one of the first shaft-support portions 33, the first projection portion 64 and the second projection portion 65 that are located at the center of a lower left one of the air-deflector plates 23 are attached. To a left end of a lower one of the second shaft-support portions 34, the first projection portion 64 and the second projection portion 65 that are located at a right portion of the lower left one of the air-deflector plates 23 are also attached.

To a front right one of the first shaft-support portions 33, the first projection portion 64 and the second projection portion 65 that are located at the center of a front right one of the air-deflector plates 23 are attached. To a right end of the front one of the second shaft-support portions 34, the first projection portion 64 and the second projection portion 65 that are located at a left portion of the front right one of the air-deflector plates 23 are also attached. In addition, to a lower right one of the first shaft-support portions 33, the first projection portion 64 and the second projection portion 65 that are located at the center of a lower right one of the air-deflector plates 23 are attached. To a right end of the lower one of the second shaft-support portions 34, the first projection portion 64 and the second projection portion 65 that are located at a left portion of the lower right one of the air-deflector plates 23 are also attached.

Figure 12:
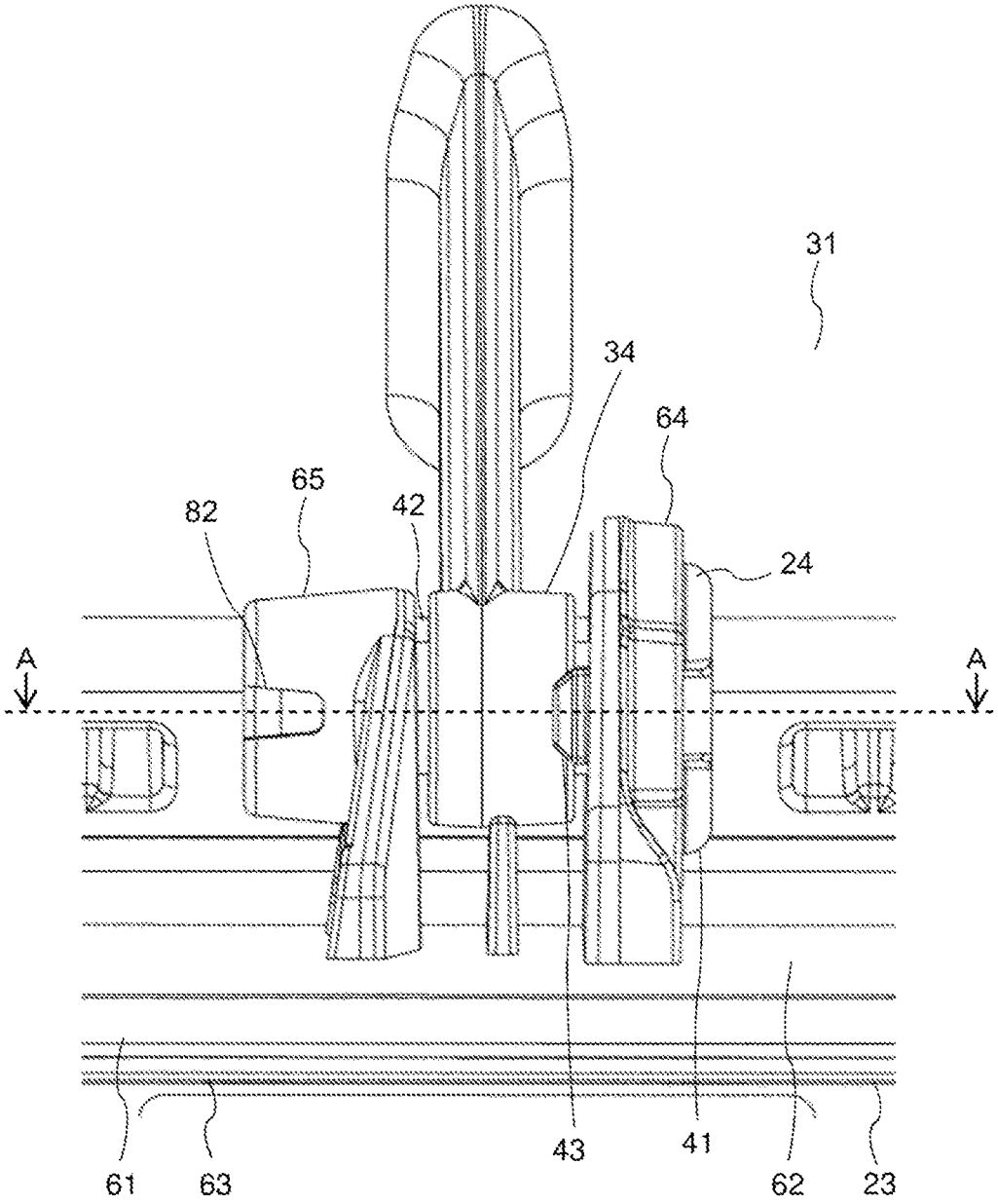
FIG. 12 is a front diagram that illustrates the air-deflector plate 23 and the attachment portion 24 according to Embodiment 1.
Figure 13:
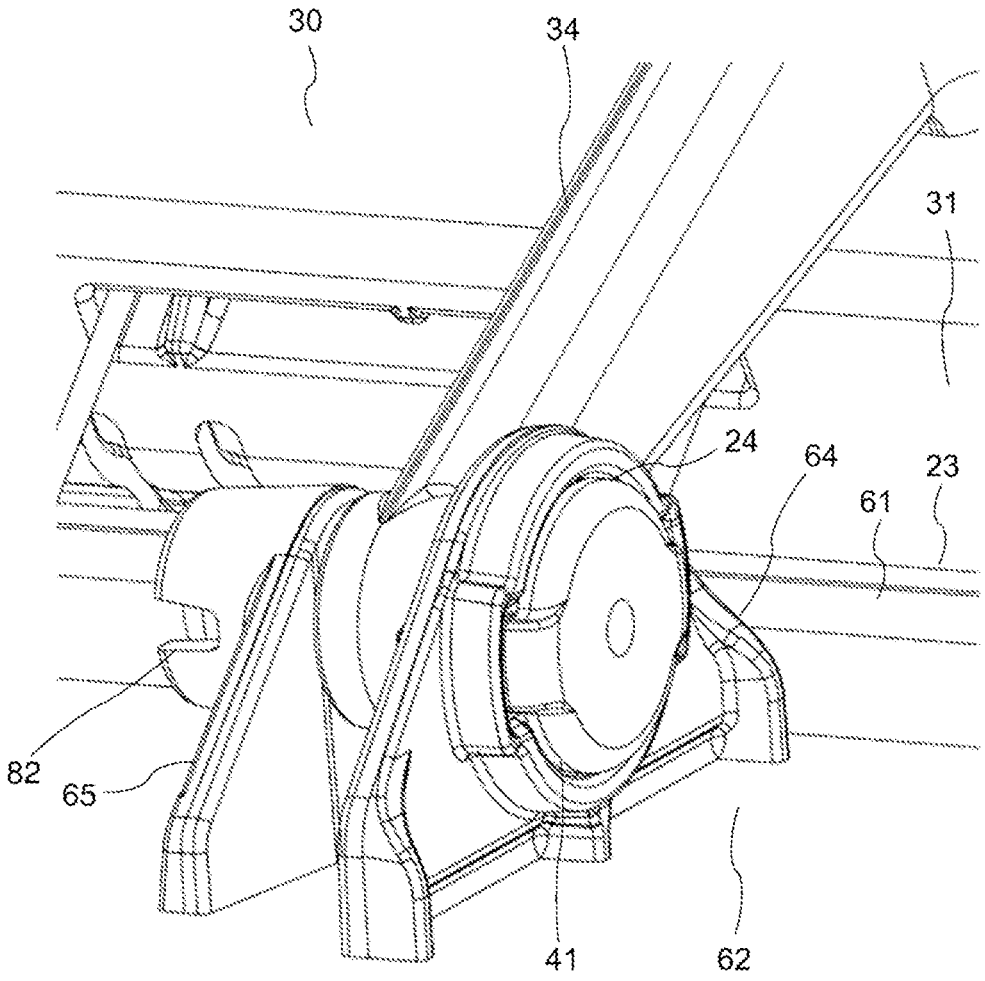
FIG. 13 is a perspective diagram that illustrates the air-deflector plate 23 and the attachment portion 24 according to Embodiment 1.
Figure 14:
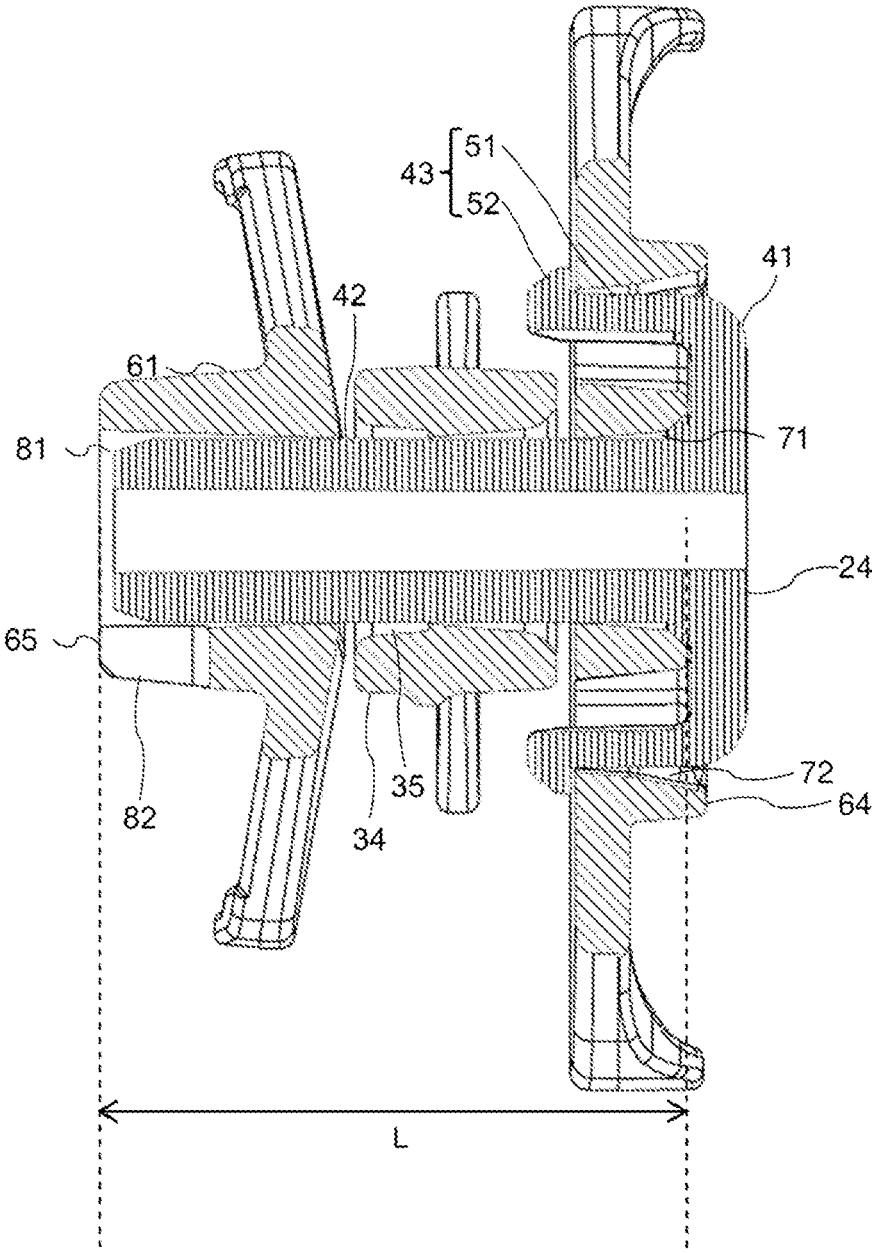
FIG. 14 is a schematic sectional diagram that illustrates the air-deflector plate 23 and the attachment portion 24 according to Embodiment 1.

FIG. 12 is a front diagram that illustrates the air-deflector plate 23 and the attachment portion 24 according to Embodiment 1. FIG. 13 is a perspective diagram that illustrates the air-deflector plate 23 and the attachment portion 24 according to Embodiment 1. FIG. 14 is a schematic sectional diagram that illustrates the air-deflector plate 23 and the attachment portion 24 according to Embodiment 1. FIG. 14 illustrates a section A-A of the air-deflector plate 23 and the attachment portion 24 illustrated in FIG. 12. With reference to FIG. 12 and FIG. 14, a state in which the air-deflector plate 23 is attached to the air-outlet unit 22 is described below in detail. FIG. 12 to FIG. 14 illustrates a case in which the first projection portion 64 and the second projection portion 65 that are located at the left portion of the front right one of the air-deflector plates 23 are attached to the right end of the front one of the second shaft-support portions 34. A positional relationship of the first projection portion 64 and the second projection portion 65 and the attachment portion 24 in a case in which the first projection portion 64 and the second projection portion 65 are attached to the lower one of the second shaft-support portions 34 or any one of the first shaft-support portions 33, which are not described in detail, is similar to a positional relationship in a case of the front one of the second shaft-support portions 34. The left ones of the air-deflector plates 23, which are also not described in detail, differ from the right ones of the air-deflector plates 23 in that the left ones and the right ones are symmetric.

As illustrated in FIG. 12 and FIG. 13, the air-deflector plate 23 is attached to the base 30 of the air-outlet unit 22 such that the first projection portion 64 and the second projection portion 65 face the air outlet 31 and the first projection portion 64 and the second projection portion 65 are located across the second shaft-support portion 34 from each other. A space is left between the second projection portion 65 and the second shaft-support portion 34 to such an extent that, in a state in which the air-deflector plate 23 moves rightward, that is, toward the first projection portion 64, the second projection portion 65 and a right end of the second shaft-support portion 34 is in contact with each other. The attachment portion 24 is inserted into the first projection portion 64, the second shaft-support portion 34, and the second projection portion 65.

As illustrated in FIG. 12 to FIG. 14, the plate portion 41 of the attachment portion 24 is in contact with a right face of the first projection portion 64 of the air-deflector plate 23. The shaft portion 42 of the attachment portion 24 is inserted into the first shaft opening port 71 of the first projection portion 64, the support opening port 35 of the second shaft-support portion 34, and the second shaft opening port 81 of the second projection portion 65. The notch 82 is cut in the second projection portion 65 in a direction in which the shaft portion 42 is inserted. A portion of the shaft portion 42 that is not covered by the second projection portion 65 is exposed through the notch 82. The notch 82 is also located at a front portion of the second projection portion. The engagement claw portions 43 of the attachment portion 24 are each inserted in the corresponding one of the claw-portion opening ports 72 of the first projection portion 64 and engaged with a left face that is opposite to the right face of the first projection portion 64. More specifically, the entirety of the rod-shaped portion 51 of each of the engagement claw portions 43 is housed in the corresponding one of the claw-portion opening ports 72 and the return portion 52 of each of the engagement claw portions 43 is engaged with the left face of the first projection portion 64.

As illustrated in FIG. 14, the length of the shaft portion 42 of the attachment portion 24 is smaller than a length L, which is from the right face of the first projection portion 64 to a left face of the second projection portion 65 of the air-deflector plate 23. That is, the distal end of the shaft portion 42 does not protrude from the left face of the second projection portion 65. A user is thus not allowed to touch the distal end of the shaft portion 42 unless the user uses a rod-shaped tool or other similar tool. A user is thus not allowed to detach the attachment portion 24 without use of a rod-shaped tool or other similar tool. The shaft portion 42 is only required to be held in the second shaft opening port 81 such that the shaft portion 42 does not come off from the second projection portion 65.

As described above, the attachment portion 24 has the plate portion 41, which is in contact with one face of the first projection portion 64, and the engagement claw portions 43, which are engaged with the other face of the first projection portion 64, which is opposite to the one face of the first projection portion 64. That is, the attachment portion 24 is fixed to the air-deflector plate 23 such that the first projection portion 64 is sandwiched by the plate portion 41 and the engagement claw portions 43 in the left-right direction. The air-deflector plate 23 is thus attached to the air-outlet unit 22 such that the air-deflector plate 23 is rotatable about the shaft portion 42, which serves as the rotation axis, in an up-down direction of the indoor unit 3.

Figure 15:
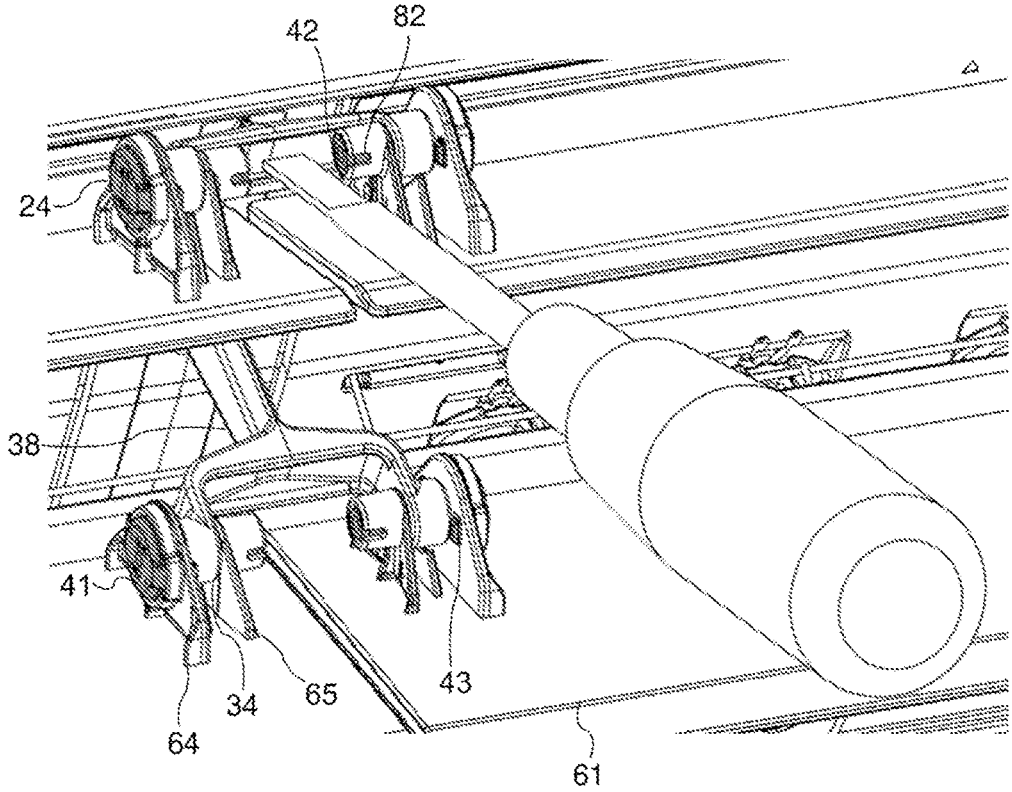
FIG. 15 is a diagram for description of a method of detaching the air-deflector plate 23 according to Embodiment 1.
Figure 16:
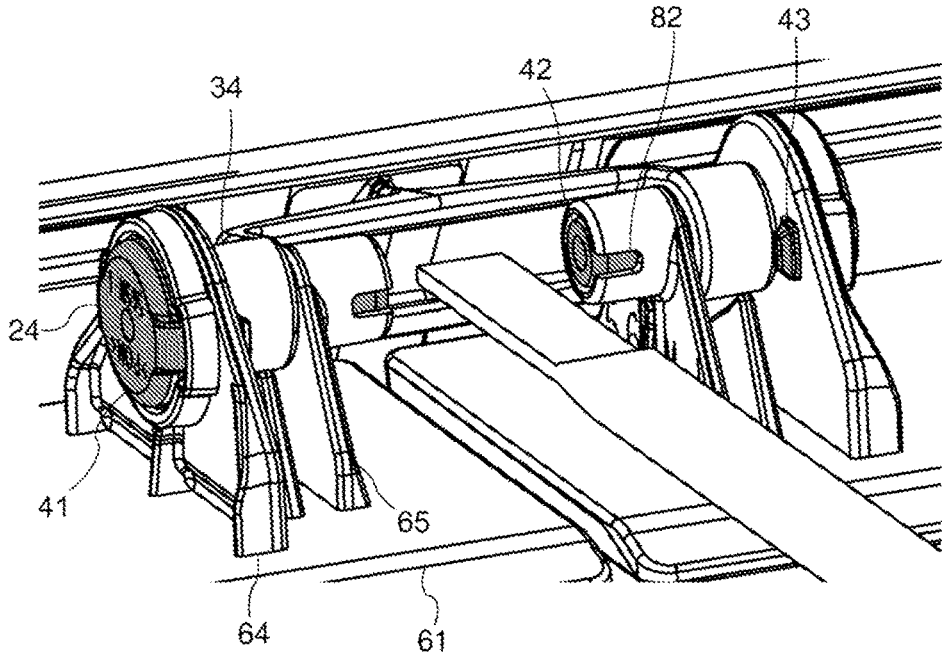
FIG. 16 is a diagram for description of the method of detaching the air-deflector plate 23 according to Embodiment 1.

FIG. 15 is a diagram for description of a method of detaching the air-deflector plate 23 according to Embodiment 1. FIG. 16 is a diagram for description of the method of detaching the air-deflector plate 23 according to Embodiment 1. FIG. 16 is an enlarged diagram that illustrates the attachment portion 24 and its vicinity. As illustrated in FIG. 15 and FIG. 16, a flat-head screwdriver is used to detach the air-deflector plate 23. To detach the air-deflector plate 23, in a state in which the air-deflector plate 23 is held, a user pushes the distal end of the flat-head screwdriver onto the distal end of the flat-head screwdriver and moves the flat-head screwdriver along the notch 82. The attachment portion 24 is thus moved toward the first projection portion 64 and the engagement claw portions 43 are bent toward the shaft portion 42 and the engagement claw portions 43 and the first projection portion 64, which are engaged with each other, are thus released from each other. A user is thus allowed to draw the attachment portion 24 out from the first projection portion 64, the second shaft-support portion 34, and the second projection portion 65 and to thus detach the air-deflector plate 23 from the air-outlet unit 22.

In Embodiment 1, the attachment portion 24 has the plate portion 41, which is in contact with one face of the first projection portion 64, and the engagement claw portions 43, which are engaged with the other face of the first projection portion 64, which is opposite to the one face of the first projection portion 64. That is, the attachment portion 24 is fixed to the air-deflector plate 23 such that the first projection portion 64 is sandwiched by the plate portion 41 and the engagement claw portions 43. The attachment portion 24 thus moves together with the air-deflector plate 23, which also moves. Even in a case in which a force is applied to the air-deflector plate 23 in the direction of the rotation axis, the attachment portion 24 thus does not come off from the air-deflector plate 23. Even in a case in which a force is applied to the air-deflector plate 23 in the direction of the rotation axis, the air-deflector plate 23 is thus prevented from falling off from the air-outlet unit 22.

In addition, since the air-deflector plate 23 is thus less likely to fall off from the air-outlet unit 22, a user easily performs maintenance, such as cleaning, in a state in which the air-deflector plate 23 is left attached to the indoor unit 3. In addition, because the indoor air-sending device 12 is less likely to be exposed to an indoor space, a user is less likely to touch the indoor air-sending device 12.

In addition, according to Embodiment 1, each of the attachment portions 24 are inserted into the support opening port 35 formed in the corresponding one of the first shaft-support portions 33 and the corresponding one of the second shaft opening ports 81 or the support opening port 35 formed in the corresponding one of the second shaft-support portions 34 and the corresponding one of the second shaft opening ports 81. In a case in which a force is applied to the air-deflector plate 23 at its first projection portion 64, the first shaft-support portion 33 or the second projection portion 65 is thus in contact with the second shaft-support portion 34. That is, a force is not applied to the attachment portion 24 at its engagement claw portions 43, and a state is thus allowed to be maintained in which the attachment portion 24 is fixed to the air-deflector plate 23 such that the first projection portion 64 is sandwiched by the plate portion 41 and the engagement claw portions 43. Even in a case in which a force is applied to the air-deflector plate 23 at its first projection portion 64, the attachment portion 24 does not come off from the air-deflector plate 23 and the air-deflector plate 23 is thus prevented from falling off from the air-outlet unit 22.

In addition, according to Embodiment 1, the attachment portions 24 each have the two engagement claw portions 43 across the shaft portion 42. Not only in a case in which a force is applied to the air-deflector plate 23 in the direction of the rotation axis but also in a case in which a force is applied to the air-deflector plate 23 in a direction twisted from the rotation axis, a state is thus maintained in which any of the engagement claw portions 43 is engaged with the first projection portion 64. The attachment portion 24 is thus much less likely to come off from the air-deflector plate 23. That is, the air-deflector plate 23 is further prevented from falling off from the air-outlet unit 22.

In addition, in Embodiment 1, the second projection portion 65 has the notch 82. In a state in which the air-deflector plate 23 is held, when the distal end of a flat-head screwdriver, which is pushed onto the distal end of the shaft portion 42, is moved along the notch 82 toward the first projection portion 64, the attachment portion 24 and the air-deflector plate 23, which are engaged with each other, are thus released from each other. A user is thus allowed to detach the air-deflector plate 23 from the air-outlet unit 22 and easily perform maintenance of the inside of the indoor unit 3.

With the indoor unit 3 for the air-conditioning apparatus 1 described in the present disclosure, a user thus easily performs maintenance, such as cleaning, in a state in which the air-deflector plate 23 is left attached to the air-outlet unit 22. Meanwhile, also when a user is to perform maintenance of the inside of the indoor unit 3, the user is allowed to easily detach the air-deflector plate 23 from the air-outlet unit 22. With the indoor unit 3 for the air-conditioning apparatus 1 described in the present disclosure, maintenance is thus further easily performed.

Modification 1

Figure 17:
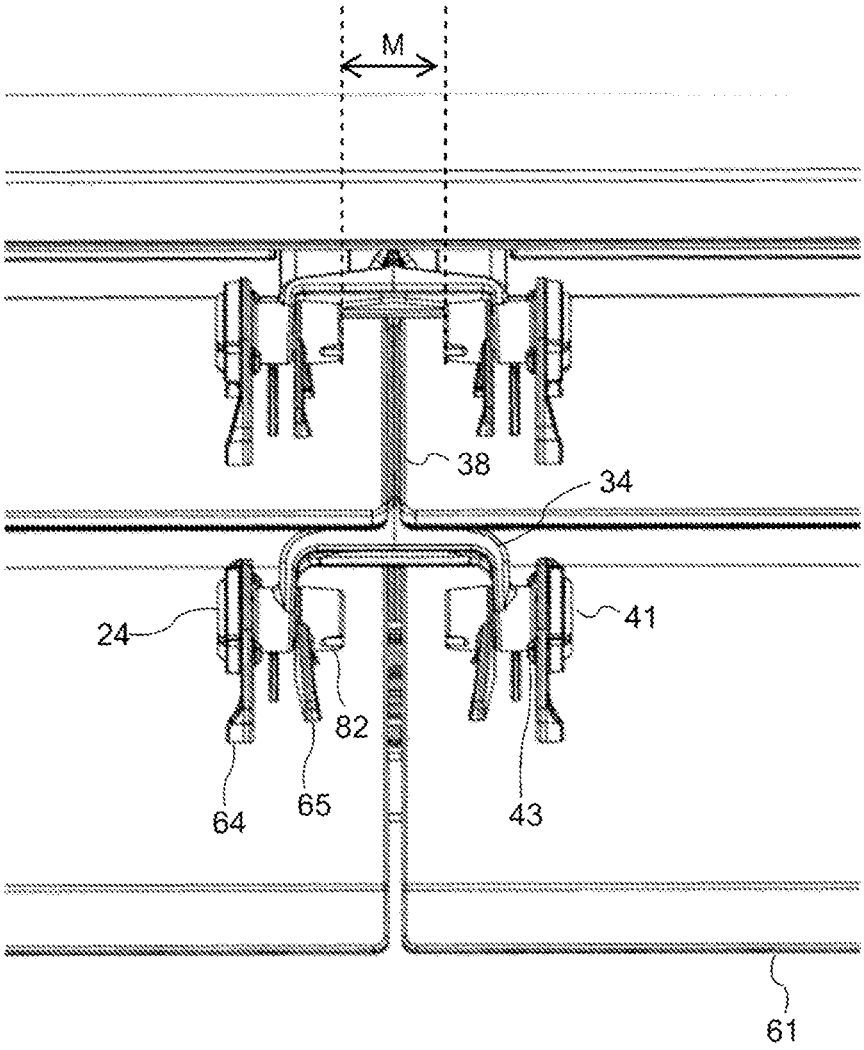
FIG. 17 is a perspective diagram that illustrates the air-deflector plate 23 and the attachment portion 24 according to Modification 1 of Embodiment 1.
Figure 18:
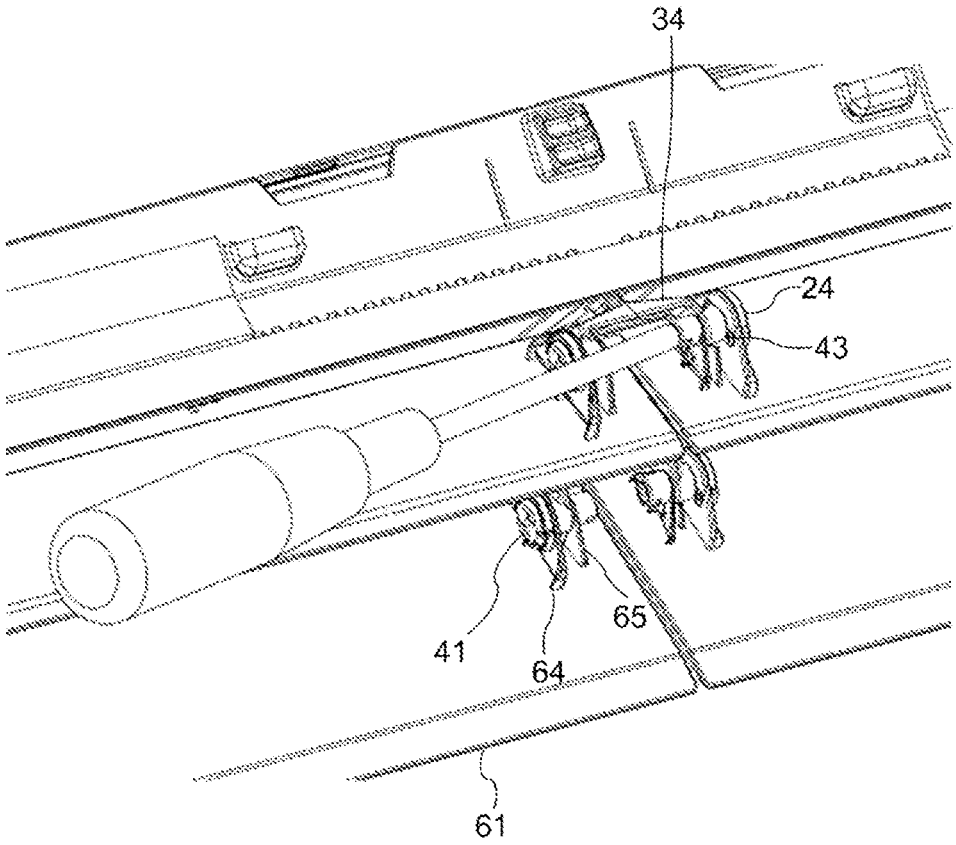
FIG. 18 is a diagram for description of a method of detaching the air-deflector plate 23 according to Modification 1 of Embodiment 1.

FIG. 17 is a perspective diagram that illustrates the air-deflector plate 23 and the attachment portion 24 according to Modification 1 of Embodiment 1. FIG. 18 is a diagram for description of a method of detaching the air-deflector plate 23 according to Modification 1 of Embodiment 1. A distance M between the first projection portion 64 of an left one of the air-deflector plates 23 and the first projection portion 64 of a right one of the air-deflector plates 23, which are illustrated in FIG. 17, is a distance that allows, as illustrated in FIG. 18, the distal end of a rod-shaped tool to be pushed onto the distal end of the shaft portion 42 in a state in which the rod-shaped tool is inclined.

As the first ep in a method of detaching the air-deflector plate 23 in Modification 1, in a state in which the air-deflector plate 23 is held, as illustrated in FIG. 18, the distal end of the rod-shaped tool is pushed onto the distal end of the shaft portion 42. The attachment portion 24 is thus moved toward the first projection portion 64 and the engagement claw portions 43 are bent toward the shaft portion 42 and the engagement claw portions 43 and the first projection portion 64, which are engaged with each other, are thus released from each other. A user is then allowed to detach the air-deflector plate 23 from the air-outlet unit 22.

In a case in which the distal end of a tool is larger in diameter than the shaft portion 42, when a flat-head screwdriver or other tool of which distal end is flat is moved along the notch 82 toward the first projection portion 64, the engagement claw portions 43 and the first projection portion 64, which are engaged with each other, are released from each other as described in Embodiment 1.

According to Modification 1, the attachment portion 24 is fixed to the air-deflector plate 23 such that the first projection portion 64 is sandwiched by the plate portion 41 and the engagement claw portions 43. The attachment portion 24 thus moves together with the air-deflector plate 23, which also moves. Even in a case in which a force is applied to the air-deflector plate 23 in the direction of the rotation axis, the attachment portion 24 is thus less likely to come off from the air-deflector plate 23. A user thus easily performs maintenance, such as cleaning, in a state in which the air-deflector plate 23 is left attached to the air-outlet unit 22. In addition, the distance M between the respective first projection portions 64 of an left one and a right one of the air-deflector plates 23 is a distance that allows the distal end of a rod-shaped tool to be pushed onto the distal end of the shaft portion 42 in a state in which the rod-shaped tool is inclined. In a state in which the air-deflector plate 23 is held, when a rod-shaped tool is pushed onto the distal end of the shaft portion 42 such that the attachment portion 24 is pushed toward the first projection portion 64, the attachment portion 24 and the air-deflector plate 23, which are engaged with each other, are thus released from each other. A user is thus allowed to detach the air-deflector plate 23 from the air-outlet unit 22 and easily perform maintenance of the inside of the indoor unit 3. As described above, with the indoor unit 3 for the air-conditioning apparatus 1 according to the present disclosure, maintenance is further easily performed.

The indoor unit 3 for the air-conditioning apparatus 1 according to the embodiment is thus described above. The indoor unit 3 for the air-conditioning apparatus 1 according to the present disclosure may also has a configuration to which various changes are applied other than the configuration disclosed in the embodiment.

For example, to a notch that is cut in the second projection portion 65, as long as an action of pushing out toward the first projection portion 64 and other actions are allowed by use of a tool, a form other than the form of the notch 82 described in Embodiment 1 may also be applied. For example, not only at the front of the indoor unit 3, the notch 82 may also be cut in a rear position opposite to the front one. In this case, an inserted flat-head screwdriver is placed along not only the front notch 82 but also the rear notch and the flat-head screwdriver is thus prevented from wobbling in an up-down direction. More significantly, the length of the notch 82 is preferred to be properly adjusted such that, when a flat-head screwdriver is moved, the length is not too small and a force is thus easily applied to the flat-head screwdriver and the length is not too large and a force is thus not excessively applied to the attachment portion 24. Similarly, the width of the notch 82 is preferred to be properly adjusted such that, when a flat-head screwdriver is inserted, the flat-head screwdriver does not wobble in an up-down direction. The form of the notch 82 may also be adjusted on the basis of the form of a tool other than a flat-head screwdriver.

In addition, the first projection portion 64 may not have claw-portion opening ports 72. In this case, the engagement claw portions 43 of each of the attachment portions 24 are each formed such that its the return portion 52 protrudes from its rod-shaped portion 51 toward the shaft portion 42. That is, the engagement claw portions 43 are in contact with an outer circumference portion of the first projection portion 64 and push the first projection portion 64 toward the shaft portion 42. In this case, the attachment portion 24 also has the plate portion 41, which is in contact with one face of the first projection portion 64, and the engagement claw portions 43, which are engaged with the other face of the first projection portion 64, which is opposite to the one face of the first projection portion 64. That is, the attachment portion 24 is fixed to the air-deflector plate 23 such that the first projection portion 64 is sandwiched by the plate portion 41 and the engagement claw portions 43. The attachment portion 24 thus moves together with the air-deflector plate 23, which also moves. Even in a case in which a force is applied to the air-deflector plate 23 in the direction of the rotation axis, the attachment portion 24 thus does not come off from the air-deflector plate 23. Even in a case in which a force is applied to the air-deflector plate 23 in the direction of the rotation axis, the air-deflector plate 23 is thus prevented from falling off from the air-outlet unit 22.

In addition, the number of the air-deflector plates 23 may also be one, two, three, five, or more. The number of the motors 32 and their locations may also be properly adjusted.

REFERENCE SIGNS LIST

1: air-conditioning apparatus, 2: outdoor unit, 3: indoor unit, 4: refrigerant pipe, 5: compressor, 6: flow-passage selector valve, 7: outdoor heat exchanger, 8: outdoor air-sending device, 9: expansion valve, 10: main-body unit, 11: outdoor heat exchanger, 12: indoor air-sending device, 20: base stand, 21: panel, 22: air-outlet unit, 23: air-deflector plate, 24: attachment portion, 30: base, 31: air outlet, 32: motor, 33: first shaft-support portion, 34: second shaft-support portion, 35: support opening port, 36: air inlet, 37: rear plate portion, 38: connection portion, 41: plate portion, 42: shaft portion, 43: engagement claw portion, 51: rod-shaped portion, 52: return portion, 61: blade portion, 62: air-guide face, 63: design face, 64: first projection portion, 65: second projection portion, 66: motor attachment portion, 71: first shaft opening port, 72: claw-portion opening port, 81: second shaft opening port, 82: notch

The invention claimed is:

1. An indoor unit for an air-conditioning apparatus, the indoor unit comprising:

an air-deflector plate that adjusts a direction of air;

an air-outlet unit that has a base in which an air outlet through which air is blown out is formed and to which the air-deflector plate is attached such that the air-deflector plate covers the air outlet; and an attachment portion to be attached to the air-outlet unit such that the air-deflector plate is rotatable, the base of the air-outlet unit having a shaft-support portion that is located at the air outlet and at which a support opening port is formed such that the support opening port opens in an axial direction around which the air-deflector plate rotates, the air-deflector plate having a blade portion that is plate-shaped, a first projection portion that projects from the blade portion toward the air outlet and at which a first shaft opening port is formed, and a second projection portion that projects from the blade portion toward the air outlet and faces the first projection portion across the shaft-support portion and at which a second shaft opening port is formed, the attachment portion having a plate portion that is in contact with one face of the first projection portion in the axial direction and is larger in width than the first shaft opening port, a shaft portion that extends from the plate portion and is inserted into the first shaft opening port, the support opening port, and the second shaft opening port, and an engagement claw portion that is engaged with an other face of the first projection portion that is opposite to the one face, the second projection portion having a notch that is cut along a direction in which the shaft portion extends and through which the shaft portion is exposed.

2. The indoor unit for an air-conditioning apparatus of claim 1, wherein the first projection portion has a claw-portion opening port formed outside the first shaft opening port, and the engagement claw portion extends from the plate portion and parallel to the shaft portion and is inserted into the claw-portion opening port.

3. A method of detaching the air-deflector plate of the indoor unit for an air-conditioning apparatus of claim 1, the method comprising:

providing the indoor unit for an air-conditioning apparatus of claim 1, initially having the air-deflector plate in a state in which the air-deflector plate is attached;

pushing a flat-shaped tool onto a distal end of the shaft portion; and moving the flat-shaped tool along the notch toward the first projection portion.

* * * * *